United States Patent [19]

Rudick et al.

[11] Patent Number: 4,950,431

[45] Date of Patent: Aug. 21, 1990

[54] MOTORLESS BATCH CARBONATOR

[75] Inventors: Arthur G. Rudick, Marietta; Jonathan Kirschner, Powder Springs, both of Ga.

[73] Assignee: The Coca-Cola Company, Atlanta, Ga.

[21] Appl. No.: 372,625

[22] Filed: Jun. 28, 1989

[51] Int. Cl.[5] ..... B01F 3/04

[52] U.S. Cl. ..... 261/140.1; 261/DIG. 7; 261/122; 261/59; 261/60

[58] Field of Search ..... 261/DIG. 7, 140.1, 122, 261/59, 60

[56] References Cited

U.S. PATENT DOCUMENTS

| | | | |
|---|---|---|---|
| 3,256,802 | 6/1966 | Karr | 261/DIG. 7 |
| 3,337,197 | 8/1967 | Iannelli | 261/DIG. 7 |
| 3,578,295 | 5/1971 | Hudson | 261/DIG. 7 |
| 3,765,318 | 10/1973 | Mazza | 261/DIG. 7 |
| 3,851,797 | 12/1974 | Jacobs | 261/DIG. 7 |
| 4,018,077 | 4/1977 | Leach | 261/104 |
| 4,393,660 | 7/1983 | Kleiner et al. | 261/DIG. 7 |
| 4,764,315 | 8/1988 | Brusa | 261/DIG. 7 |
| 4,781,889 | 11/1988 | Fukasawa et al. | 261/122 |

OTHER PUBLICATIONS

American Heritage Dictionary, 2nd College Ed., Apr. 1982, p. 784.

PCT/GB83/00202, Published Mar. 1, 1984, Published International Application.

*Primary Examiner*—Tim Miles

*Attorney, Agent, or Firm*—Birch, Stewart, Kolasch and Birch

[57] ABSTRACT

A motorless batch carbonator for a carbonated drink dispenser is located in a chilled water bath including a set of evaporator coils located on the outside of the water bath with the ice build up on the inside thereof being controlled by an ice bank detector. The carbonator is comprised of an immersible closed tank including a semi-permeable membrane carbonating section where still water and $CO^2$ gas are mixed together. Still water from a pressurized source is fed into the interior of the carbonator tank which is pressurized to operate a spring-biased spool valve for opening and closing a $CO^2$ supply line. A vent passage through the top of the carbonator chamber is opened and closed to atmospheric pressure in response to the manual actuation of a spring-biased dispensing plunger which includes a fluid dispensing path. A constrained spherical float device resides on the surface of the carbonated water inside of the tank and to open and close the vent passage and thus control tank pressurization and operation of the spool valve controlling the supply of $CO^2$.

20 Claims, 3 Drawing Sheets

MOTORLESS BATCH CARBONATOR

Background of the Invention

This invention relates generally to carbonating apparatus for use in connection with post-mix beverage dispensing systems and more particularly to a carbonator for delivering carbonated water in a relatively low cost beverage dispenser and one which is particularly adapted for home use.

Various types of apparatus for making and dispensing carbonated water for a carbonated beverage dispensing system are generally well known. In such apparatus, uncarbonated or still water is supplied to a mixing tank from a source, normally through some type of pump assembly, with the depth of the water being controlled in response to demand. Both motor driven pump assemblies as well as motorless or pneumatic pump driven assemblies for supplying uncarbonated or still water into the tank are generally known. The water in the carbonator tank is mixed with carbon dioxide gas from a pressurized source where it is absorbed and delivered to a dispensing valve where the carbonated water is then mixed with a measured amount of beverage concentrate or syrup to provide a carbonated beverage.

Summary of the Invention

It is an object of the present invention, therefore, to provide an improved apparatus for making and dispensing carbonated water.

It is a further object of the invention to provide an improved apparatus for dispensing carbonated water in a relatively low cost dispenser.

It is another object of the invention to provide an improvement in a carbonator unit for a post-mix beverage dispenser.

It is still another object of the invention is to provide a relatively simple in-line batch carbonator for a post-mix beverage dispensing system.

And yet a further object of the invention is to provide an improvement in a carbonator for a beverage dispenser for use with a motorless water pump.

The foregoing and other objects are realized by a motorless batch carbonator for a carbonated drink dispenser located in a chilled water bath including a set of evaporator coils located on the outside of the water bath with the ice build up on the inside thereof being controlled by an ice tank detector. The carbonator is comprised of an immersible tank including a semi-permeable membrane carbonating section where still water and $C0^2$ gas are mixed together. Still water from a pressurized source is fed into the interior of the carbonator tank which is pressurized to operate a spring-biased spool valve for opening and closing a $C0^2$ supply line. A vent at the top of the carbonator chamber is opened and closed to atmospheric pressure in response to the actuation of a spring-biased dispensing plunger. A constrained float device resides on the surface of the carbonated water inside of the tank and to open and close the vent and thus control tank pressurization and operation of the spool valve controlling the supply of $C0^2$.

Brief Description of the Drawings

A more complete understanding of the invention will be had by referring to the following detailed description when taken in conjunction with the accompanying drawings wherein.

Detailed Description of the Invention

Figure 1:
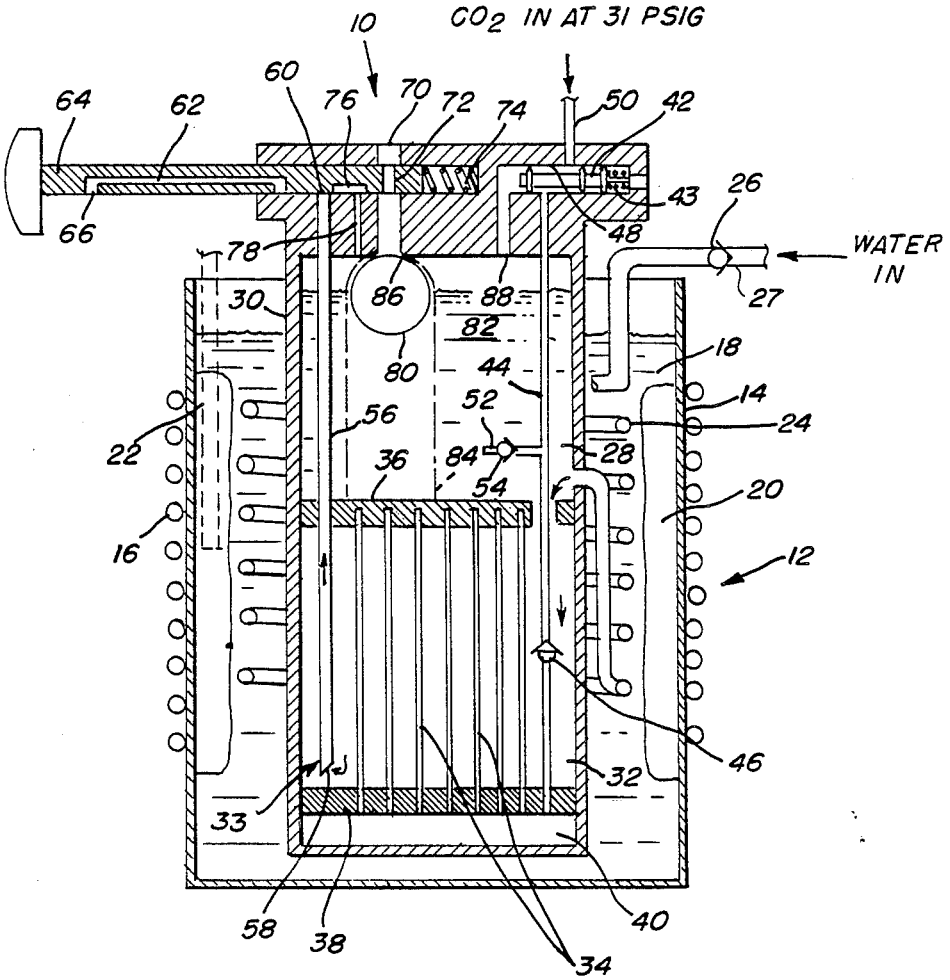
FIG. 1 is a mechanical schematic diagram illustrative of the preferred embodiment of the invention.

Referring now to the drawings and more particularly to FIG. 1, reference numeral 10 denotes a carbonator tank for a post-mix carbonated beverage dispenser, not shown, immersed in a mechanically refrigerated water bath assembly 12 including water tank 14 having a set of evaporator coils 16 wrapped around the outer surface thereof. The evaporation of refrigerant within the coils 16 operates to cool a volume of water 18, causing an ice bank 20 to be built up on the inner surface of the water tank 14. An ice bank detector shown schematically by reference numeral 22 is responsive to the build up or thickness of the ice bank 20 to control refrigerant flow through the evaporator coils 16 in a well known fashion.

The carbonator assembly 10 is comprised of a pre-chiller coil 24 for uncarbonated or still water and having one end coupled to a pressurized source of uncarbonated or still water from a source such as a municipal water supply pipe, not shown, through a one-way check valve 26. The other end of the pre-chiller coil 24 is connected to an upper chamber 28 of a closed carbonator tank 30 additionally including a lower chamber 32 wherein there is located a semi-permeable membrane carbonating gas transfer assembly 33 consisting of a plurality of hollow semi-permeable membrane fibers 34 which are vertically mounted between a pair of horizontal support members 36 and 38. The fibers 34 are closed off at the upper end by the support member 36, while their lower end is open to a carbonating gas plenum chamber 40 which is coupled to a source of carbonating gas, typically carbon dioxide ($C0^2$) by means of a spring biased spool valve assembly including a spool valve 42 and an interior $C0^2$feed line 44 through a check valve 46. A spool valve chamber 48 is connected to a source of $C0^2$ by means of an inlet line 50. The $C0^2$ feed line 44 feeding $C0^2$ into the plenum chamber 40 also includes an upper branch line 52 including a check valve 54 for feeding $C0^2$ directly into the upper chamber 28.

A vertically descending carbonated water output tube 56 passes through the support member 36 down into the lower chamber 32 where there is an open input end 58. The upper end of the carbonated water output tube 56 terminates in an opening 60 which is adapted to be connected to a fluid outlet path 62 located in a manually operated spring-biased dispensing plunger 64 including an outlet port 66. The fluid outlet path 62 also couples to means, not shown, for providing a measured quantity of syrup concentrate for mixing with the carbonated water fed from the line 56 in the carbonator tank 30.

The dispensing plunger 64 is shown mounted horizontally in a solid top portion of the carbonator tank 30 which includes a vent passage 70 into the top of the upper chamber 28. The plunger 64 also includes a transverse opening 72 for coupling the upper and lower portions of the vent passage 70 together when the plunger 64 is in the "rest" or unactuated position and biased outwardly by means of a compression spring 74.

Figure 2:
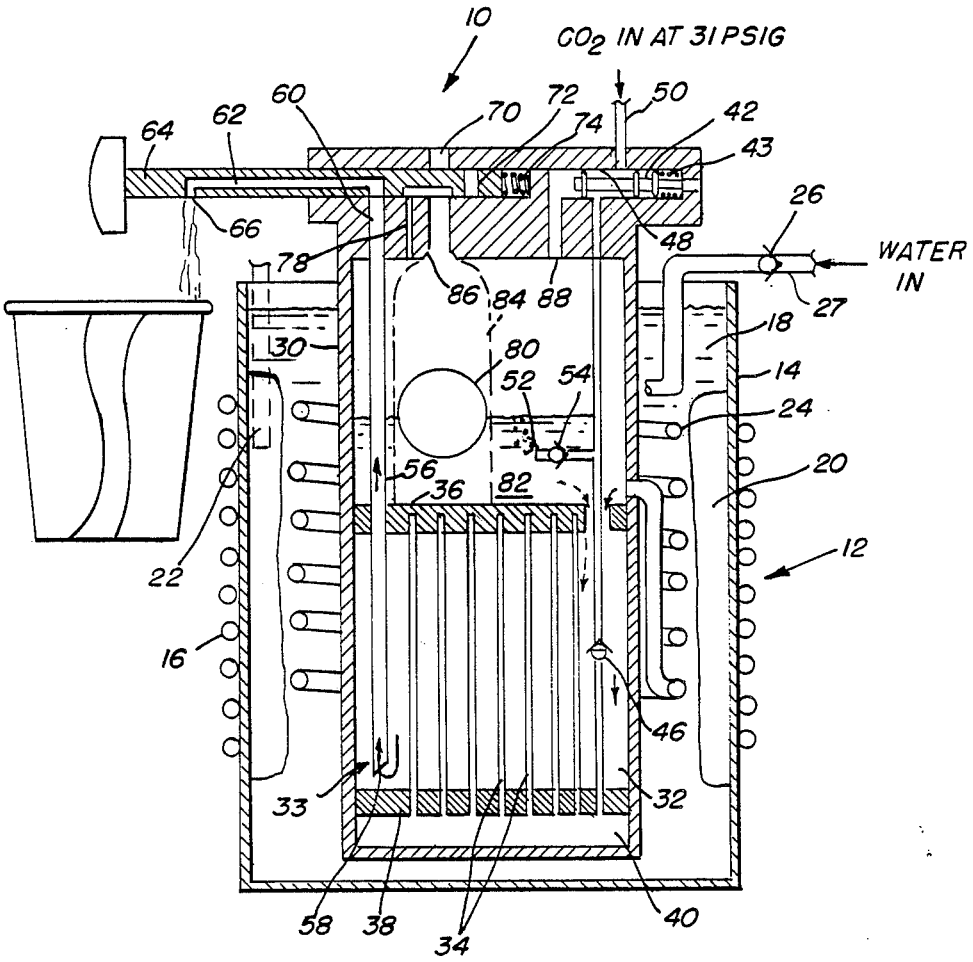
FIGS. 2 and 3 are diagrams further illustrative of the embodiment shown in FIG. 1 for providing a better understanding of the operation of the subject invention.

The plunger 64 furthermore includes a horizontal channel section 76 for connecting the lower portion of the vent passage 70 with an adjacent vertical passage 78 into the upper chamber 28 when the plunger is manually actuated and pushed inwardly against the spring 74 as shown in FIG. 2.

A float member 80, shown in FIG. 1 in the form of a sphere, is adapted to float on the surface of the carbonated water 82 in the upper chamber 28. The float 80 resides in means 84 for restraining lateral movement as the depth of the carbonated water 82 varies and to insure that it is guided to seat over the inner opening 86 of the vent passage 70 whenever it is at the top of the carbonator tank 30 as shown in FIG. 1. While the float 80 is shown as being spherical, it should be noted that when desirable it can be configured in other shapes as well.

Completing the structure shown in FIG. 1, a vertical inner passage 88 is also provided in the upper portion of the tank 30 which couples the internal pressure in the upper chamber 28 to the sPool valve 42.

Considering now the operation of the preferred embodiment of the invention, as shown in FIG. 1, the vent passage 70 at the top of the carbonator tank 30 is in the "open" position and the float 80 is firmly seated over the opening 86 due to the pressure differential between the interior of the carbonator tank 30 and the outside atmospheric pressure, effectively closing the vent passage 70 so as to keep the interior of the carbonator pressurized. This figure depicts the carbonator assembly at rest and being substantially filled with carbonated water and ready for a dispensing operation.

Referring now to FIG. 2, when the dispensing plunger 64 is manually pushed inwardly, the fluid outlet path 62 lines up with the opening 60 of the carbonated water outlet tube 56. Also the channel portion 76 connects the lower portion of the vent passage 70 with the adjacent vertical passage 78. The upper portion of the vent passage 70 is shut off due to the movement of the transverse passage 72 of the plunger 64 to the right against the spring 74 which becomes compressed. Carbonated water follows an upward path through the tube 56 to the dispensing port 66 where it is received by a container shown in FIG. 2. Again and although not shown in FIG. 2, there is provided means for mixing syrup concentrate with the carbonated water prior to its arrival at the dispensing port 66.

With the plunger 64 in the "in" position, the pressure in the lower portion of the vent tube 70 is allowed to equalize with the interior pressure in the upper carbonator chamber 28 via the connection to the passage 78 by the channel portion 76. This permits the float 80 to fall away from the inner opening 86 of the vent passage 70 as the water level drops during a dispensing operation. The function of check valve 26 is to prevent reverse flow in the incoming water line 27. The incoming water line 27 is connected to a source of water, not shown, such as a municipal water supply. The pressure of this supply can vary from only slightly above 0 psi to over 100 psi. During the dispensing part of the cycle, as shown in FIG. 2, the carbonator is always pressurized to 31 psi. During the dispensing part of the cycle when check valve 26 is oriented as shown, if the source pressure is greater than 31 psi, then water will continue to flow from the source through the check valve 26 into the carbonator via the pre-chiller coil 24. If the source pressure is less than 31 psi, the check valve 26 closes, preventing water from flowing in reverse from the carbonator back through the check valve towards the water source. $C0^2$ from the input line 50 and the spring biased spool valve 42 maintains the interior of the carbonator housing 30 pressurized at the level of the $C0^2$, i.e., 31 psi, and provides the driving force to dispense the carbonated water from the lower chamber 32. This also ensures that the water pressure will always equal the $C0^2$ pressure inside the hollow fibers 34. The uPper chamber 28 acts like a reservoir, and therefore the volume of the upper chamber 28 must be greater than or equal to that of the largest quantity that the system is expected to dispense.

The still water fed into the upper carbonator chamber 28 from the pre-chiller coils 24 is carbonated as it flows around and past the bundle of hollow semi-permeable fibers 34 which permit $C0^2$ to pass through their respective walls but will not allow water to pass therethrough into the fibers. As long as the water pressure outside the fibers 34 is greater or equal to the $C0^2$ pressure inside the fibers, the $C0^2$ will be absorbed directly into the water in the lower chamber 32 without the formation of bubbles. As long as the water pressure exceeds the $C0^2$ pressure, a maximum amount of $C0^2$ that can be absorbed by the water is strictly a function of $C0^2$ pressure and water temperature totally independent of water pressure. The lower plenum chamber 40 pressurizes the insides of the hollow semi-permeable membrane fibers 34 to the same pressure as the water. With the water cooled at 35° F., a $C0^2$ pressure of 31 psi, for example, will produce a theoretical absolute carbonation level of 5.0 volumes.

Figure 3:
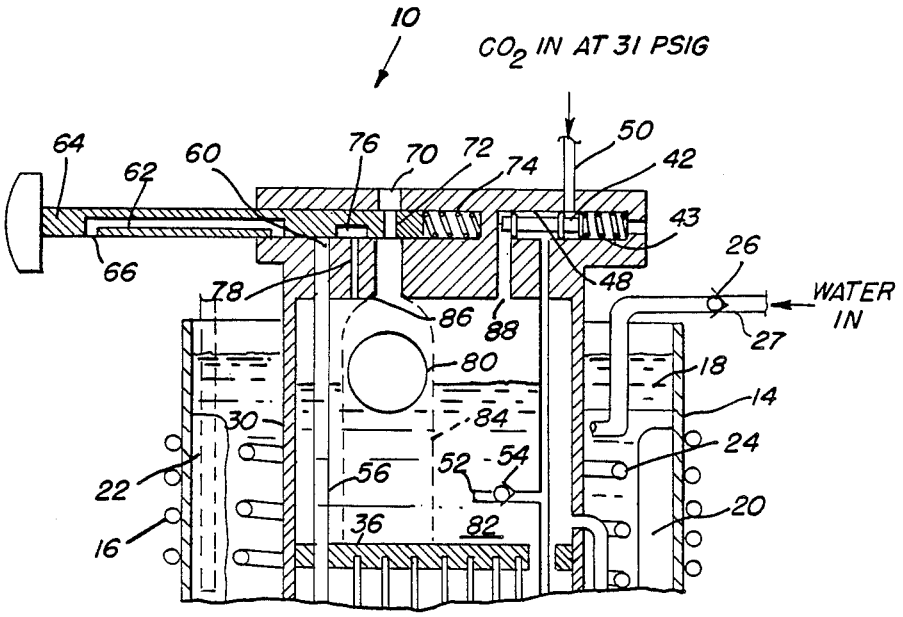

Referring now to FIG. 3, when a dispensing operation is completed, the user releases the dispensing plunger 64 which returns to the "out" position due to the bias exerted by the compressed spring 74. This interrupts the carbonated water flow out of the dispensing port 66 due to the misregistration of the flow path 62 with the outlet line 56. The vent passage 70 is now again open to the atmosphere. Without the float 80 sealing the vent passage 70, the pressure in the upper chamber 28 vents to the atmosphere much more rapidly than is replaced by the $C0^2$ from the branch line 52. When the pressure in the carbonator tank 30 drops below about 10 psi, the spool valve 42 moves to the left as shown in FIG. 3 due to the pressure exerted by the bias spring 43, thereby shutting off the $C0^2$ supply to the carbonator during refilling.

Due to the fact that the interior of the carbonator tank 30 is vented to atmosphere, the carbonator tank will fill even if the incoming still water pressure is relatively low. The incoming still water, however, must have a minimum pressure of 10 psi in order to reopen the spool valve 42. As the water level rises in the upper chamber 28 of the carbonator tank 30, the float 80 will reseal the vent passage 70 as shown in FIG. 1. At this point the incoming still water will begin to repressurize the interior of the carbonator. When the internal pressure exceeds 10 psi, the spool valve 42 moves back to the right, again reopening the $C0^2$ supply line 44 and the carbonator is recharged and is again ready for a new dispensing cycle.

If the incoming still water pressure is greater than 31 psi, the check valve 54 in the upper $C0^2$ outlet branch line 52 will close off. When this occurs, the incoming still water will continue to flow into the carbonator housing 30 during dispensing. The incoming water itself will keep the interior pressure of the carbonator housing 30 pressurized, providing the driving force to dispense carbonated water and thus assuring that the water pressure will always be greater than or equal to that inside of the hollow semi-permeable membrane fibers 34 in the lower chamber 32. In such an instance, the water level will never drop inside the carbonator. The carbonator assembly 10 will then function as a simple in-line continuous carbonator during a dispensing operation. Therefore, no $C0^2$ will be vented to atmosphere if the incoming water pressure exceeds 31 psi.

Having thus shown and described what is at present considered to be the preferred embodiment of the invention, it should be noted that the same has been made by way of illustration and not limitation. Accordingly, all alterations, changes and modifications coming within the spirit and scope of the invention as set forth in the appended claims are herein meant to be included.

We claim:

1. Carbonator apparatus for a beverage dispenser, comprising:

a carbonator tank for mixing uncarbonated water with a carbonating gas and thereafter holding and dispensing the carbonated water therefrom;

a carbonating section in said tank including a semi-permeable membrane assembly including a plurality of hollow semi-permeable membrane fibers for providing a fluid conduit for carbonating gas;

means for feeding carbonating gas to said semi-permeable membrane assembly from an external source of carbonating gas;

means for feeding uncarbonated water into said tank from an external source and causing said uncarbonated water to flow around and contact said semi-permeable membrane fibers, whereby said carbonating gas passes through said membrane fibers and dissolves into said uncarbonated water to form carbonated water thereby; and means for dispensing carbonated water from said tank and including a carbonated water output tube extending into said carbonating section and a dispensing member having an outlet port registerable with said output tube when actuated to dispense carbonated water therefrom.

2. The carbonated apparatus as defined by claim 1 wherein said assembly of semi-permeable membrane fibers is located in the lower portion of said tank and wherein the upper portion of said tank comprises a reservoir for water to be dispensed.

3. The carbonated apparatus as defined by claim 1 wherein said dispensing member comprises a spring biased dispensing member on said tank.

4. The carbonator apparatus as defined by claim 1 wherein said fibers are located in substantially mutual parallel linear relationship in the lower portion of said container.

5. The carbonator as defined by claim 4 wherein said output tube comprises an elongated dispensing tube which extends down into said tank in the vicinity of said plurality of semi-permeable membrane fibers.

6. The carbonator apparatus as defined by claim 5 wherein said plurality of fibers comprise elongated semi-permeable membrane fibers linearly disposed in the lower portion of said tank.

7. The carbonator apparatus as defined by claim 6 wherein said semi-permeable membrane fibers are aligned substantially vertically in said tank.

8. The carbonator apparatus as defined by claim 1 and additionally including refrigeration means for cooling the interior of said carbonating tank.

9. The carbonator apparatus as defined by claim 8 and further including means for pre-cooling the uncarbonated water fed into said carbonating tank.

10. The carbonator apparatus as defined by claim 1 wherein said means for feeding carbonating gas includes valve means responsive to the internal pressure in said carbonator tank connected between said source of carbonating gas and said semi-permeable membrane fibers for controlling when carbonating gas is to be supplied to said plurality of semi-permeable membrane fibers.

11. The carbonator apparatus as defined by claim 10 wherein said valve means comprises a spring biased spool valve.

12. The carbonator apparatus as defined by claim 1 wherein said carbonator tank includes a bore in the top portion thereof and wherein said dispenser member comprises a spring loaded manually operated plunger mounted in said bore.

13. The carbonator apparatus as defined by claim 12 wherein the top portion of said tank includes a vent passage into the tank intersecting said bore and wherein said plunger includes a transverse opening therethrough and being in registration with said vent passage when said plunger is in an inoperative position.

14. The carbonator apparatus as defined by claim 13 and additionally including float means in the upper portion of said carbonator tank and being responsive to the water level in said tank for seating against said vent passage upon rising to the top of the carbonator tank.

15. The carbonator apparatus as defined by claim 14 wherein the top portion of said carbonator tank includes a passage adjacent said vent passage and being partially through the top portion of said tank from the interior of the tank and wherein said plunger includes a channel section connecting an inner portion of said vent passage to said adjacent passage when said plunger is manually pushed inwardly.

16. The carbonator apparatus as defined by claim 14 wherein said float means comprises a spherical floating body which floats on top of water in said upper portion of said carbonating tank.

17. The carbonator apparatus as defined by claim 16 and additionally including means for insuring that said floating body seats against said vent passage each time it rises to the top of said carbonating tank.

18. Carbonator apparatus for a beverage dispenser, comprising:

a carbonator tank for mixing uncarbonated water with a carbonating gas and thereafter holding and dispensing the carbonated water therefrom;

a plurality of hollow semi-permeable membrane fibers located in the lower portion of the tank in a generally parallel arrangement for providing a fluid conduit for the carbonating gas and wherein the upper portion of the tank comprises a water reservoir;

means for feeding carbonating gas to said semi-permeable membrane fibers from an external source of carbonating gas;

means for feeding uncarbonated water into said tank from an external source and causing said uncarbonated water to flow around and contact said semi-permeable membrane fibers, whereby the carbonating gas passes through said membrane means and dissolves into the uncarbonated water to form carbonated water thereby; and means for dispensing carbonated water from said tank including a carbonated water output tube extending down into the tank in the vicinity of said semi-permeable membrane fibers and a dispensing member on said tank having an outlet port registerable with said output tube when actuated to dispense carbonated water therefrom.

19. The carbonator apparatus as defined by claim 18 wherein said dispensing member comprises an externally operated dispensing member.

20. The carbonator apparatus as defined by claim 18 wherein said dispensing member comprise a spring biased dispensing member.

* * * * *